United States Patent [19]

Reed et al.

[11] 4,347,052

[45] Aug. 31, 1982

[54] LOW NOX BURNER

[75] Inventors: Robert D. Reed; Richard R. Martin; Hershel E. Goodnight, all of Tulsa, Okla.

[73] Assignee: John Zink Company, Tulsa, Okla.

[21] Appl. No.: 26,325

[22] Filed: Apr. 2, 1979

Related U.S. Application Data

[63] Continuation-in-part of Ser. No. 916,766, Jun. 19, 1978, Pat. No. 4,257,763.

[51] Int. Cl.[3] ..... F23Q 9/00

[52] U.S. Cl. ..... 431/188; 431/284

[58] Field of Search ..... 431/12, 19, 90, 175, 431/188, 187, 284, 285, 351, 174; 239/400, 407, 413, 414, 416.2, 416.5, 416.4, 422, 424

[56] References Cited

U.S. PATENT DOCUMENTS

| | | | |
|---|---|---|---|
| 2,247,768 | 7/1941 | Huwyler | 431/188 X |
| 2,269,333 | 1/1942 | Bloom | 431/188 |
| 2,672,190 | 3/1954 | Schumann | 431/188 X |
| 2,857,961 | 10/1958 | Brown et al. | 431/116 |
| 3,822,654 | 7/1974 | Ghelfi | 431/284 X |
| 3,940,234 | 2/1976 | Reed et al. | 431/114 X |
| 4,004,875 | 1/1977 | Zink et al. | 431/9 |
| 4,095,929 | 6/1978 | McCartney | 431/19 |
| 4,144,016 | 3/1979 | Takahashi et al. | 431/188 X |
| 4,201,538 | 5/1980 | Kopp | 431/351 |
| 4,257,763 | 3/1981 | Reed | 431/188 |

*Primary Examiner*—Samuel Scott
*Assistant Examiner*—Randall L. Green
*Attorney, Agent, or Firm*—Head & Johnson

[57] ABSTRACT

A fluid fuel burner system for minimum production of NOX under varying rates of fuel firing and varying rates of combustion air or oxidant supply, which comprises a fuel burner including means for burning liquid and gaseous fuel. Liquid fuels are burned in an axial burner tube, and the gaseous fuels are burned in a plurality of gas burner tubes located in a circle coaxial with the liquid burner. A first air or oxidant plenum supplies primary-plus-secondary air or oxidant, the primary air or oxidant going to the liquid burner and the secondary air or oxidant going to the gas burner. The total of primary plus secondary is less than stoichiometric flow so that the combustion of the fuel in a first combustion chamber provides a reducing atmosphere to preclude the formation of NOX. Means are provided for independently controlling the primary air or oxidant flow compared to the secondary air or oxidant flow, or vice versa. A second air or oxidant plenum provides tertiary air or oxidant to a second combustion space downstream of the first combustion chamber. Control means provide independent control of the primary-plus-secondary air or oxidant flow to the first plenum as a selected ratio to the tertiary air or oxidant, that flows to the second plenum.

4 Claims, 3 Drawing Figures

LOW NOX BURNER

CROSS REFERENCE TO RELATED APPLICATION AND PATENT

This continuation-in-part application is an improvement over pending application Ser. No. 916,766, filed June 19, 1978, now U.S. Pat. No. 4,257,763.

Ser. No. 916,766 now U.S. Pat. No. 4,257,763 is entered into this Application by reference.

BACKGROUND OF THE INVENTION

1. Field of the Invention

This invention lies in the field of liquid and gaseous fuel burning. More particularly, this invention concerns fuel burning apparatus in which the design of the burner and control of the fuel and air or oxidant supply is separately controllable for primary, secondary and tertiary air or oxidant, so as to maintain a minimum value of NOX in the effluent gases.

2. Description of the Prior Art

The burning of fuels, however it is accomplished in burners, as they are known in the art of fuel burning, is productive of oxides of nitrogen (NOX) in normal operation. Such oxides of nitrogen as are produced in combination with olefininc hydrocarbons, which may be present in the atmosphere, constitute a major source of smog.

Smog, while not necessarily lethal, is recognized universally as potentially damaging to animal tissue. Consequently, several limitations on the NOX content of stack gases vented to the atmosphere as a result of fuel burning, have been imposed by various governmental authorities and agencies.

The prior art is best represented by U.S. Pat. No. 4,004,875. This patent has been the basis of a wide appliacation of low NOX burners in the natural gas field. Scores of burners, which are based on this patent, are in commercial service, where they have a suppressed NOX as intended. However, the optimum operation of the prior patent has been for fixed rates of fuels burning, where a good balance can be provided between the primary and secondary air or oxidant supplies to a first combustion chamber and a supply of additional tertiary air or oxidant downstream of the first combustion chamber.

The weakness of the prior design is that for one condition of furnace draft or firing rate the operation is ideal. However, when the firing rate changes significantly, such as from 100% to 80%, as is typical of daily process heater firing, there is difficulty in maintaining NOX suppression. The reason for this is that, at reduced firing rate, the furnace draft remains constant or approximately so, and increased air-to-fuel ratios destroy the less-than-stoichiometric burning zone prior to tertiary air delivery, which results in less-than-optimum NOX reduction plus higher than desirable excess air.

What is required is a burner which provides means for correction for any condition of firing such as might be required when the furnace draft remains substantially constant, as changes in firing rates are made. If such corrections can be made, the result is continuation of NOX suppression and maintenance of optimum excess air for high thermal efficiency. In the prior art burner there is no control of the tertiary air which is caused to flow by furnace draft, while the primary and secondary air also flow for the same reason.

The total air flow will vary as the square root of the furnace draft. Thus, only one rate of fuel burning or firing rate, at a condition of furnace draft, will provide the required excess air and NOX suppression. This would seem to indicate that control of the air flow would provide some benefit. What is not immediately evident is that the air entry control must be proportionately controlled for maintenance of a less-than-stoichiometeric burning zone prior to the entry of tertiary air to the less-than-stoichiometric gases, for completion of fuel burning, plus preferred excess air when firing rate is caused to vary. If the conditions, as outlined, are maintained, there is a suitable NOX suppression in any condition of draft and firing rate, and the furnace excess air remains best for high thermal efficiency. This is to say that control of primary, secondary and tertiary air must be proportional and simultaneous for best and most assured operation in all firing conditions.

SUMMARY OF THE INVENTION

It is a primary object of this invention to provide a burner for use of liquid and/or gaseous fuel to burn with low NOX in the effluent gases.

It is a further object of this invention to provide a burner system which will provide low NOX burning for a wide range of fuel burning rate and corresponding air or oxidant supply rate.

These and other objects are realized and the limitations of the prior art are overcome in this invention by providing a fuel burning system that includes means for combustion of liquid fuels through a first burner along the axis of the burner system. Gaseous fuels are burned through a second burner system, which provides a plurality of burner heads arranged in a circle coaxial with the liquid burner and slightly downstream therefrom. Means are provided for separately controlling the ratio of primary air or oxidant which flows to the liquid burner along the axis of the burner system into a first combustion spaced to the flow of secondary air or oxidant which flows through an annular passage surrounding the first burner system to emerge in the vicinity of the gas burners.

There is a first combustion chamber downstream of the first and second burners and the supply of primary-plus-secondary air or oxidant to the fuel in the first combustion chamber is less than stoichiometric, so that the flame is a reducing flame, which will reduce any NOX that may be formed and will inhibit the production of NOX within the first combustion chamber.

Tertiary air or oxidant is provided, which is also separately controlled, to the space downstream of the first combustion chamber so that the hot products of incomplete combustion issuing from the first combustion chamber are burned to completion by the addition of tertiary air or oxidant.

The ratio of primary-plus-secondary air or oxidant to the total air, that is primary-plus-secondary-plus-tertiary air, is such that the first combustion chamber has less-than-stoichiometric air so as to maintain the reducing atmosphere. With the addition of the tertiary air, the total air supply is greater than stoichiometric, for the fuel supply by an optimum selected percentage.

It is characteristic of burner art that the chosen source of oxygen for oxidation, in exothermal reactions, of fuel components is air, and the air, as used may be considered as a fuel oxidant, or source of oxygen. It can be said that it is common knowledge in the art that the more common oxides of nitrogen will "support " combustion which is exothermal oxidation of fuels for heat-energy production which is combustion or the burning of fuels. It may be that, in the art we here reveal, there are multiple sources for oxidant gases such as air as well as a mixture of air with industrially-produced oxides of nitrogen; also, an adequate supply of oxides of nitrogen per se. It is within the scope of the fuel burning device we reveal to make use of either air as such, air plus oxides of nitrogen or oxides of nitrogen for the same reduced NOX in the gases which are ultimately produced as the result of fuels burning.

In the prior art means have been provided for controlling the ratio of primary-plus-secondary air or oxidant to tertiary air or oxidant, so that a constant ratio can be provided, even though the total supply varies, as the total fuel supply rate varies. However, we have found that it is important also to control the relative flow of primary air or oxidant versus secondary air or oxidant, as they flow into the first combustion chamber, since this has a marked effect upon the total NOX production in the combustion process.

In one embodiment of our invention the control of primary-plus-secondary air or oxidant in relation to tertiary air or oxidant is provided by having two combustion air or oxidant plena. A first plenum receives primary combustion air or oxidant through a flow-rate control means. The outlfow of air or oxidant from the first plenum goes through at least two openings, one opening leading to the secondary burners, and forming the secondary air or oxidant supply, the other opening going to the primary burner, and constituting the primary air or oxidant supply. The ratio of primary-to-secondary air or oxidant is provided by controlling the size of at least one of these two openings, so that a desired ratio of primary-to-secondary air or oxidant can be obtained, whereas the total flow rate of primary-plus-secondary air or oxidant is controlled with a common flow control means.

The second combustion air or oxidant plenum is positioned downstream of the first plenum and has a single outlet which supplies tertiary air or oxidant to a second combustion space downstream of the first combustion chamber. There is less-than-stoichiometric air or oxidant condition in the first combustion chamber. By adding tertiary air or oxidant this changes to more-than-stoichiometric air or oxidant supply for completion of the combustion of the fuel in the second combustion space. The air or oxidant flow to the second plenum is also controlled by a flow control means, such as a damper or similar means.

The air or oxidant flow to the first and second plena can be under forced draft, or under control of air inspiration due to the flow of gas and/or liquid fuel through nozzles from a high pressure to atmospheric pressure, whereby primary-plus-secondary combustion air or oxidant is induced. The tertiary air or oxidant under that condition, would be induced by furnace draft, due to the less-than-atmospheric pressure condition inside the furnace. However, it is possible also to provide a forced draft from blowers positioned upstream of the flow control means leading to the first and second plena.

The combustion air or oxidant flow into the first and second plena, which are circular volumes, can be through a radial conduit or tangential conduit, which can provide flow in clockwise or counterclockwise directions as desired. Such control of the air or oxidant flow aids in the control of flame volume and shape but has a minimum effect on the question of NOX production. NOX production is due principally to the relative quantity of primary air or oxidant to secondary air or oxidant to tertiary air or oxidant and means are provided for controlling each of these three air or oxidant flows independently.

Means can also be provided for the introduction of water in gaseous or liquid form in the first plenum so that by reforming action, the water will provide additional quantities of carbon monoxide and hydrogen, which will enhance the reduction of any NOX that might form in the combustion chamber.

BRIEF DESCRIPTION OF THE DRAWINGS

These and other objects and advantages of this invention and a better understanding of the principles and details of the invention will be obvious from the following description taken in conjunction with the appended drawings in which.

DESCRIPTION OF THE PREFERRED EMBODIMENT

Figure 1:
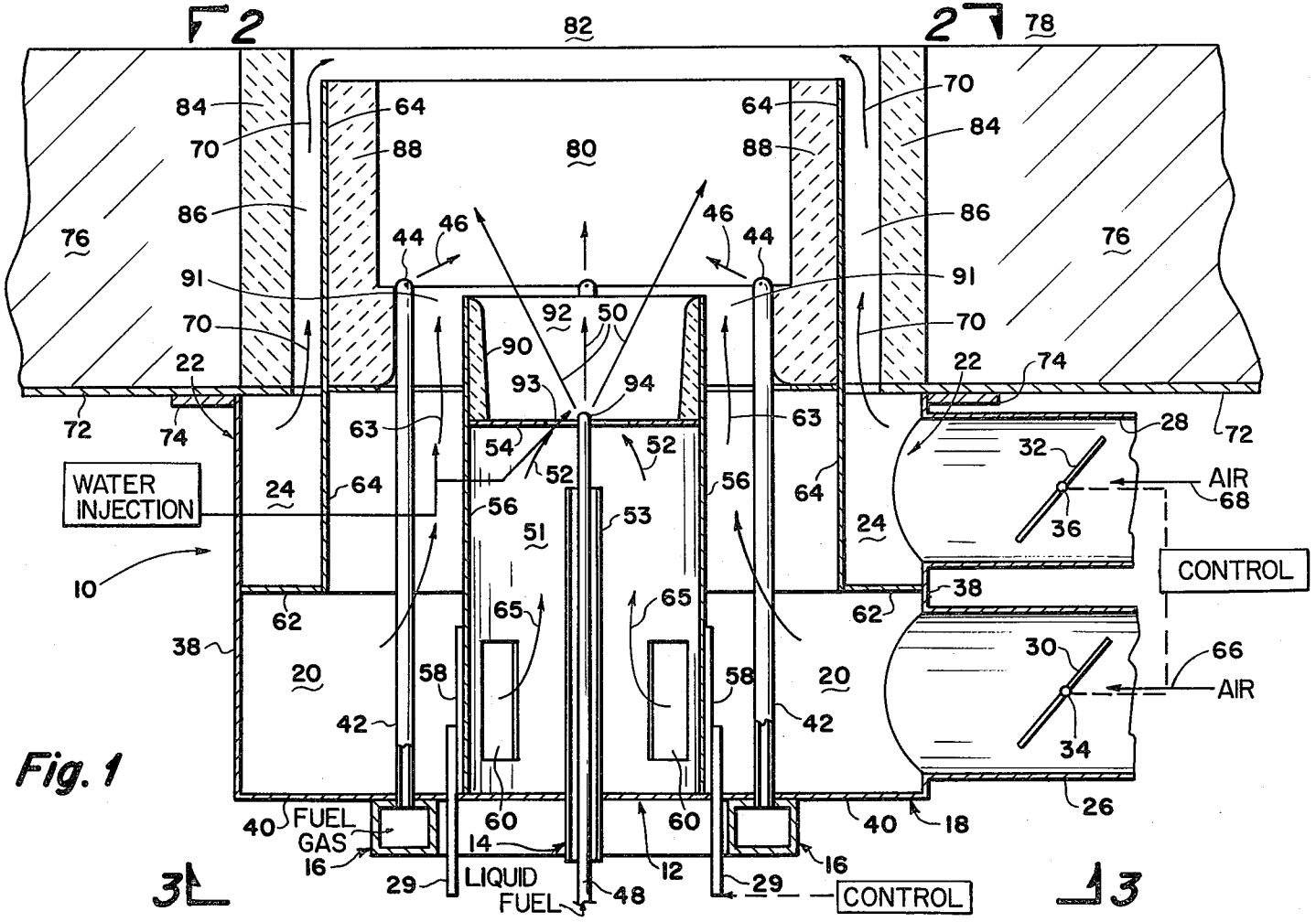
FIG. 1 is a horizontal cross-section through one embodiment of this invention.

Referring now to the drawings and, in particular, to FIG. 1, there is shown one embodiment of the invention, indicated generally by the numeral 10. This comprises a burner system for liquid and gaseous fuels, in a furnace with independent control of primary, secondary and tertiary air, for the purpose of maintaining a minimum NOX in the effluent gases.

The burner apparatus per se is indicated generally by the numeral 12. The liquid burner apparatus is indicated generally by the numeral 14, and is positioned on the axis of the burner system 10. A plurality of gaseous burner elements are connected to a manifold indicated generally by the numeral 16, which provides combustion of gaseous fuel, and is for convenience indicated as a secondary burner, the liquid burner being the primary burner.

There is a cylindrical wall 56 which divides the zone of the primary, or liquid fuel burner, from the secondary or gaseous fuel burner. A first plenum, indicated generally by the numeral 18, surrounds the first burner and is provided with primary-plus-secondary air in accordance with arrow 66 through a conduit 26. Damper means 30 rotatable around a shaft 34 provide control of the total flow of air through the conduit 26 to the first plenum interior space 20.

The liquid burner has an interior burner tube 48 through which liquid fuel is flowed under pressure. At the downstream end there is a burner head having a plurality of orifices 94 through which liquid fuel flows outward as jets 50, in a conical-shaped wall. Immediately surrounding the primary burner head, or liquid burner head, is a small chamber 92, in which combustion of the liquid fuel starts. This space 92 is lined with refractory tile 90, which is supported by the steel cylinder 56 and a bulkhead 54, having a central opening 93 surrounding the first burner so that primary air can flow in accordance with arrows 52.

Downstream of the chamber 92 is a first combustion chamber 80 which has refractory tile wall 88. An annular space 91 is provided between the wall 56 and the tile 88 for the flow of secondary air in accordance with arrows 63.

There are at least two openings from the first plenum space 20. One of these openings is the annular passage 91. The other at least one opening, are the pair of openings 60 shown through the wall 56 which separates the primary burner from secondary or gaseous burner.

Surrounding the wall 56 is a steel sleeve 58, which has openings of the general shape and size as the openings 60 in the cylinder 56, so that by rotating the sleeve 58 by means of handles 29, the opening 60 can be completely uncovered so that air from the plenum space 20 can flow in accordance with arrow 65 through the openings 60, into the space 51 inside of the cylinder 56. Thus, there are two separate and independent air flows from the first plenum space 20. One of these is indicated by the flow of secondary air in accordance with arrow 63 up into the first combustion chamber 80 through the passage 91. The second path is through the control openings 60 which can be varied from full open to close, if desired, by rotating the sleeve 58 by means of handles 29. Thus, control the quantity of air flow 65 into the space 51 and through the central opening 93 in accordance with arrows 52 to mix with and provide oxygen for combustion of the liquid fuel in the jets 50 within the space 92. Of course, the burning fuel moves on downstream into the primary combustion chamber 80. Consider the space 92 as a precombustion chamber upstream of the primary combustion chamber 80.

In the combustion chamber 80, gaseous fuel will be discharged from the burner heads 44, which have a plurality of orifices, so that gas jets 46 are provided. These jets mix with the secondary air 63 to burn, in conjunction with, or in place of, the liquid fuel jets 50.

The total amount of primary-plus-secondary air supplied through the arrows 65 and 63, respectively, from the first plenum, in total, are less-than-stoichiometric quantity for complete combustion of the combustibles in the fuel. This less-than-stoichiometric flow for the air causes a reducing atmosphere in the combustion chamber 80, which precludes the formation of nitrogen oxides.

The second plenum, indicated generally by the numeral 22, has an annular volume 24, which is supplied through a conduit 28. The tertiary air in accordance with arrow 68 is controlled by the damper means 32, which rotates about a transverse shaft 36. Any other type of air control can, of course, be used. The tertiary air from the plenum 22 flows in accordance with arrows 70 through the annular space 86 outside of the tile 88 and wall 64, and within a second or outer tile 84. This tertiary air 70 flows through annular passage 86 into the space 82, which is within the furnace wall, and serves to provide additional oxygen so that all the combustibles can be burned.

In review, there is a primary burner head 94, which is inserted through a tube 53, which is supported by a backplate 40 of the burner system. Liquid fuel is supplied through the pipe 48 under pressure and flows out of nozzles in the burner head 94 in the form of high velocity jets of miniscule droplets of liquid fuel, through the precombustion chamber 92 into the first combustion chamber 80. A secondary burner provides a manifold 16 with a plurality of gas burner tubes 42 with burner heads 44 which provide high velocity jets of gas 46 directly into the first combustion chamber 80. Primary air plus secondary air is supplied through a conduit 26 in accordance with arrow 66 under control 30 into a first plenum indicated generally by the numeral 18 and having an interior volume 20. This primary-plus-secondary air flows in two general directions downstreamwise through the annular opening 91 to the vicinity of the gaseous burner tips 44 and into the sprayed jets of gas 46, while the primary air flows in accordance with arrow 65 through the openings 60 in the wall 56 and 60 in the sleeve 58, under control of the sleeve 58, by rotation around the cylinder 56. This primary air flows in accordance with arrows 52 through the opening 93 in plate 54 to supply primary air for the liquid fuel. It will be clear that once the control 20 is set for the total flow of primary-plus-secondary air, that the relative flows in accordance with arrows 63 and 65 will depend very much on the size of the total openings 60 available for the primary air. Thus, a wide range of control of the relative magnitude of flow of primary and secondary air can be provided independently of the total flow of primary-plus-second air controlled by 30.

The total volume of flow of primary-plus-secondary air 65 and 63 is less than stoichiometric, so that in the space 80 there is a reducing atmosphere, to preclude the formation of NOX. These hot gases then flow downstream into the furnace inside of the wall 76 and into the space 82, where the reducing gases then meet the tertiary air and continue their combustion, but in a lower temperature environment.

The items 66 and 68, combined, supply more oxygen for fuel burning than is stoichiometrically required by a selected amount for the quantity of fuel supplied by either/both 44 and 94. Either air, or a suitable fuel oxidant, can be supplied as 66–68 and, since these are not necessarily from a common source and at a common pressure and analysis, it is necessary to provide separate flow quantity control means for each as 30 for 66 and 32 for 68 in order to maintain a reducing condition within 80 to avoid NOX evolution as 70 meets combustible-laden gases as they move forward, and in the direction of 82 for complete burning of combustibles downstream of 80 through addition of a selected quantity/volume of air or suitable oxidant. The oxidant can be air or a mixture of air and industrially-produced oxides or nitrogen, if the oxygen contained is totally greater than a stoichiometric quantity, by a selected amount, for the fuel being burned.

The furnace space is indicated as 78 except for the region immediately downstream of the first combustion zone which is indicated as 82, and is considered as a second combustion zone. The furnace wall is indicated as 76, which is of suitable ceramic or refractory construction and an outer steel protective plate 72 is provided, to which the burner system can be attached by means 74, for example, as is well-known in the art.

It is well-known that, in the reducing atmosphere in the first combustion zone 80, there is incomplete combustion of the fuel and, therefore, there will be present carbon monoxide and hydrogen and other combustibles. It is also well-known that the introduction of water in the form of vapor or minute droplets with the primary and secondary combustion air can produce additional quantities of carbon monoxide and hydrogen in the primary combustion chamber 80 with beneficial effects as regards the quantity of NOX produced. While we have not shown the presence of such water or water vapor in the path of the primary and secondary air flows 65 and 63, it is possible to provide these in the first plenum as shown in Ser. No. 916,766, with increased benefit to the reduction of NOX in the effluent gases.

The primary improvement of this invention over the prior art lies within the segregation of the primary and secondary air flows from each other, and from the tertiary air flow and the provision of means whereby each of the three air flows can be individually or simultaneously controlled in selected ratios to the other two.

One way of doing this is to combine primary and secondary air through one conduit and one control means 30 and tertiary air through a second conduit and control means 32 so that the total flow can be varied, while maintaining a desired ratio between primary plus secondary, and tertiary. However, in this embodiment we have provided additional means to relatively control the magnitudes of primary and secondary air given a total flow of primary plus secondary air. This individual control can also be provided by having three separate conduits (not shown) such as 26 and 28, for example, with three separate damper control means, which would be an alternate form of apparatus to the one which is shown in FIG. 1.

Figure 2:
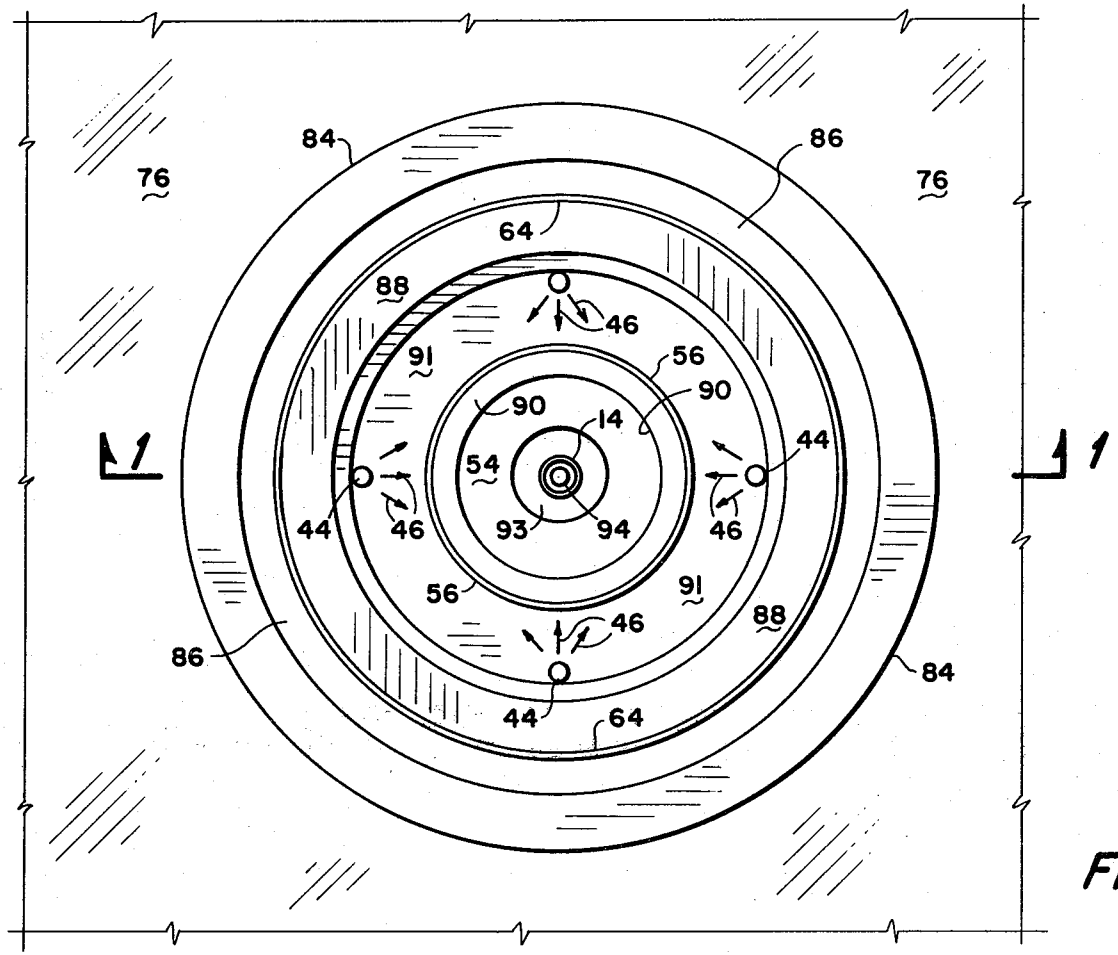
FIG. 2 is an elevational view taken from inside the furnace.
Figure 3:
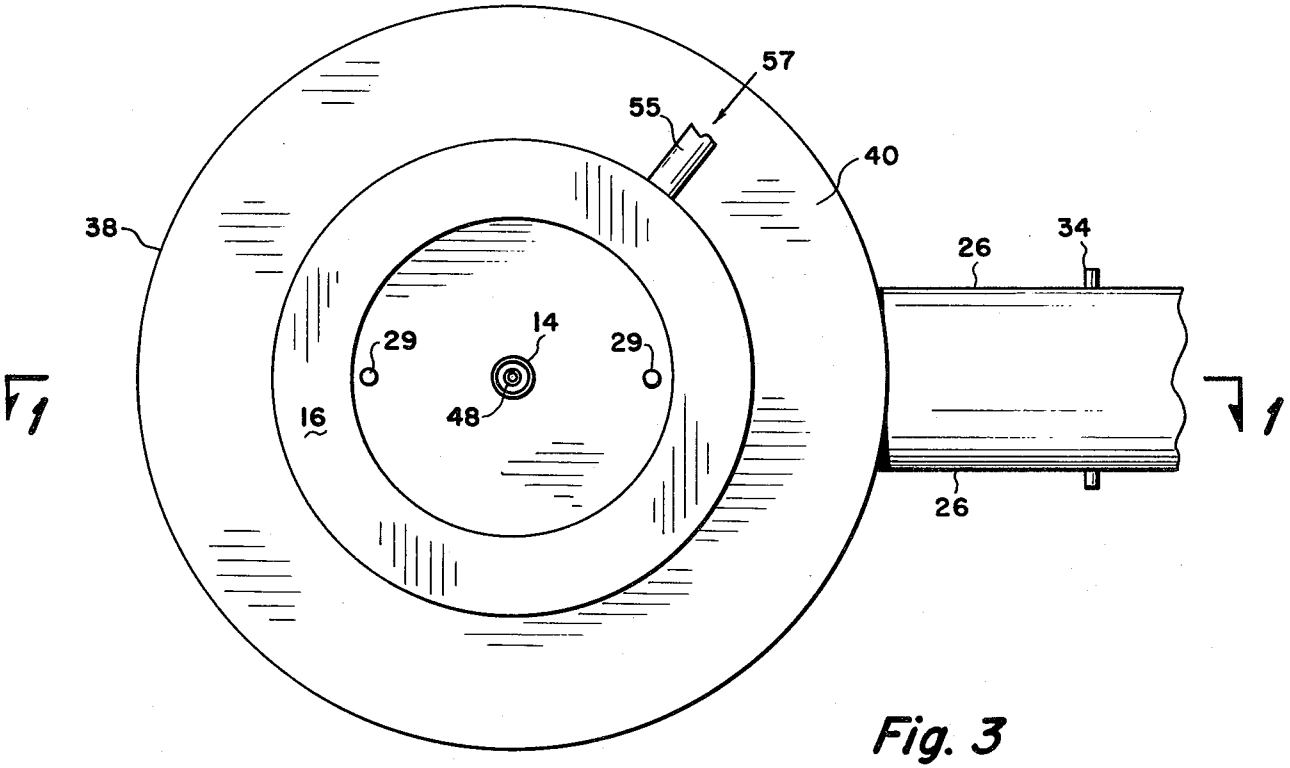
FIG. 3 is a vertical elevational taken from outside the furnace.

FIGS. 2 and 3 are shown for further clarity of the arrangement of apparatus. FIG. 2 shows an elevation view from inside of the furnace, and shows the central tile 90, the inner tile 88, and the outer tile 84, with the primary liquid burner head 94 along the axis of the burner system, and a plurality of secondary gas burners with burner heads and orifices 44, for example.

FIG. 3 shows a view from the outside in which the gas supply to the manifold 16 is supplied through pipe 55 in accordance with gas flow 57.

The air supply conduits, such as 26, are shown in FIG. 3. The conduit 58 is hidden immediately behind conduit 26. These can be radial, as shown, or they can be tangential to the plena that they feed with consequent benefits in control of the flame dimensions, etc.

While this invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element or step thereof is entitled.

What is claimed is:

1. In a fluid fuel burner positioned in a furnace opening for minimum production of NOx burner under variable rates of fuel supply having a refractory lined first combustion space with an opening thereto which contains a centrally located pre-combustion space opening into said first combustion space and having a liquid fuel nozzle therein; a plurality of coaxially located gaseous fuel nozzles for directing gaseous fuel from a gaseous fuel source into said first combustion space, a primary combustion air chamber surrounding said liquid fuel nozzle for introduction of primary combustion air into said pre-combustion chamber, means to supply secondary air into a first annular space formed between the opening in said first combustion space and said pre-combustion space, the total of said primary and secondary air being supplied from a single controllable source and thence divided into said primary and secondary portions, a second annulus between said first combustion space and said furnace opening to supply tertiary air from a separate controllable source to immediately downstream of said first combustion space and means to ignite the resulting combustion fuel-air mixture, the improvement comprising means to control the amount of primary air into said pre-combustion chamber and means to simultaneously control the single controllable source of said primary-secondary air and the separate controllable source of said tertiary air whereby the total of said primary-secondary air in the first space is less than stochiometric while the amount of tertiary air will make the total air greater than the stoichiometric requirements of the fuels being burned.

2. The system as in claim 1 wherein the total of primary and secondary air is in the range of 60 to 75% of the total air requirements for stoichiometric burning.

3. The system as in claim 1 in which said means to control said primary combustion air chamber comprises:

(a) a centrally located inner cylindrical wall through which said primary air flows, said wall positioned within a plenum which receives said primary and secondary air;

(b) a plurality of symmetrically-spaced circumferential openings in said inner wall for the passage of said primary air from said plenum; each of said openings of selected angular width W and length P;

(c) a rotatable cylindrical continguous sleeve surrounding said wall and means for rotating said sleeve;

(d) a corresponding set of openings in said sleeve as in said wall;

whereby as said sleeve is rotated said openings in said wall can be completely open or partially open as desired;

whereby the ratio of primary to secondary air can be controlled.

4. The system as in claim 1 including water atomization means in the vicinity of said fuel burner and upstream thereof.

* * * * *